US006557273B2

(12) United States Patent
Polifroni

(10) Patent No.: US 6,557,273 B2
(45) Date of Patent: May 6, 2003

(54) LAYERED ARCH SUPPORT AND METHOD OF MANUFACTURE

(76) Inventor: Joseph Paul Polifroni, c/o 261 N. Highway 101, Solona Beach, CA (US) 92075

( * ) Notice: Subject to any disclaimer, the term of this patent is extended or adjusted under 35 U.S.C. 154(b) by 0 days.

(21) Appl. No.: 09/965,995

(22) Filed: Sep. 28, 2001

(65) Prior Publication Data

US 2003/0061735 A1 Apr. 3, 2003

(51) Int. Cl.[7] ..... A43B 7/14; A43B 7/16; A43B 13/38; A43B 23/00; A61F 5/14

(52) U.S. Cl. ..... 36/44; 36/145; 36/172; 36/173; 36/178

(58) Field of Search ..... 36/145, 166, 173, 36/178, 181, 180, 154, 160, 172, 174, 176, 44

(56) References Cited

U.S. PATENT DOCUMENTS

| | | | | | |
|---|---|---|---|---|---|
| 2,408,792 | A | | 10/1946 | Margolin | |
| 2,486,653 | A | | 11/1949 | Hukill | |
| 2,821,032 | A | | 1/1958 | Helfet | |
| 2,978,818 | A | | 4/1961 | Baumann | |
| 3,081,774 | A | | 3/1963 | Lelyveld | |
| 3,135,265 | A | | 6/1964 | Holzman | |
| 3,306,967 | A | | 2/1967 | Turkewitsch | |
| 3,333,353 | A | | 8/1967 | Garcia | |
| 3,543,765 | A | | 12/1970 | Alzner | |
| 3,985,853 | A | | 10/1976 | Weisberg | |
| 4,187,620 | A | | 2/1980 | Selner | |
| 4,541,184 | A | * | 9/1985 | Leighton | 36/178 |
| 4,571,857 | A | * | 2/1986 | Castellanos | 36/173 |
| 4,694,590 | A | | 9/1987 | Greenawalt | |
| 4,702,255 | A | * | 10/1987 | Schenkl | 36/145 |
| 4,718,179 | A | * | 1/1988 | Brown | 36/173 |
| 4,972,612 | A | | 11/1990 | Prukop et al. | |
| 5,282,326 | A | * | 2/1994 | Schroer, Jr. et al. | 36/181 |
| 5,359,791 | A | | 11/1994 | Prahl et al. | |
| 5,394,626 | A | * | 3/1995 | Brown | 36/173 |
| 5,463,824 | A | | 11/1995 | Barna | |
| 5,611,153 | A | * | 3/1997 | Fisher et al. | 36/173 |
| 5,636,456 | A | * | 6/1997 | Allen | 36/166 |
| 5,940,994 | A | * | 8/1999 | Allen | 36/166 |
| 6,247,250 | B1 | * | 6/2001 | Hauser | 36/173 |

* cited by examiner

*Primary Examiner*—Anthony D. Stashick
(74) *Attorney, Agent, or Firm*—Brown, Martin, Haller & McClain LLP

(57) ABSTRACT

An arch support device has a lower layer of a rigid or semirigid material shaped to conform to the arch of a wearer's foot and to provide an arch supporting function when inserted in a shoe, a second layer of cushioning material such as foam secured to the upper face of the lower layer; and a third, cover layer of pliable material secured over the second layer. The foam layer is of variable thickness, with a maximum thickness in a heel region and a minimum thickness in a toe region.

10 Claims, 2 Drawing Sheets

LAYERED ARCH SUPPORT AND METHOD OF MANUFACTURE

BACKGROUND OF THE INVENTION

The present invention relates to arch or foot supports for insertion in footwear in order to provide better comfort and more correct positioning and support of the wearer's feet.

Many individuals who are on their feet or walking for significant periods of time encounter the problems of pain and sore feet usually associated with uncomfortable footwear. Such problems often arise as a result of insufficient arch support in conventional shoes and other footwear. Thus, various types of shoe inserts have been devised in order to alleviate such problems. Some inserts consist only of a foam or padded cushion member or insole, and provide no arch support. It is also known to provide more sophisticated arch supports formed of molded rigid or semirigid materials, such as plastic, and these are sometimes custom-fitted to the individual, which makes them relatively expensive. Also, the rigid nature of such arch supports can itself lead to some discomfort. In some cases, a leather upper layer is applied to the top surface of the arch support, but this device may still not be particularly comfortable in some cases. A layered arch support device is also known which has a lower, rigid plastic layer, a second or core layer of foam material, and an upper leather layer. However, this becomes fairly thick and bulky at the toe and may cause problems in inserting the foot into the shoe.

SUMMARY OF THE INVENTION

It is an object of the present invention to provide a new and improved arch support for insertion in footwear.

According to one aspect of the present invention, an arch support device is provided, which comprises a first, lower layer of a rigid or semirigid material shaped to conform to the arch of a wearer's foot and to provide an arch supporting function when inserted in a shoe, the lower layer having a lower face for facing the sole of an item of footwear and an upper face, a second layer of cushioning material secured to the upper face of the lower layer, and a third, cover layer of pliable material secured over the second layer, the device having a heel region at one end, and arch region, and a toe region at an opposite end, the cushioning layer being of variable thickness and having a maximum thickness in the heel region and a minimum thickness at the toe region.

The cover layer may be of a relatively smooth, moisture-resistant material such as leather or fabric, while the cushioning layer may be of foam. In an exemplary embodiment, the inner layer is of substantially rigid, molded plastic material. With this arrangement, the inner layer provides adequate support for the arch of the foot, while the upper cushioning and cover layers make the arch support more comfortable for the wearer. In an exemplary embodiment, the foam layer is tapered to reduce in thickness to a minimum thickness in the toe region which is of the order of 25% to 75% of the maximum thickness.

The arch support device will be made for fitting left and right footwear, and in different sizes to accommodate the standard range of footwear sizes. The device may have an outer periphery designed to substantially match that of the sole of the footwear in which it is to be inserted, or may extend over only part of the sole, from the heel region up to a point adjacent the wearer's toes. The second, cushioning layer and upper cover layer may be of slightly larger dimensions than the rigid, arch support layer such that a cushioning rim portion projects a short distance beyond the rim of the rigid lower layer, for added comfort of the wearer, such that their feet will not bear against any rigid part of the support device.

By tapering the foam layer from the heel to the toe, the region of maximum thickness is associated with the maximum pressure regions of the wearer's sole when standing or walking. At the same time, the reduced thickness at the toe provides more rigid support, and also enables the foot to enter the shoe more easily with the arch support in place.

According to another aspect of the present invention, a method of manufacturing an arch support device is provided, which comprises the steps of:

forming a molded, rigid or semirigid plastic lower layer having an upper surface and a lower surface, the lower layer being shaped to conform to the shape of at least part of a wearer's foot in order to provide an arch support when worn in footwear;

roughening the upper surface of the plastic lower layer;

applying adhesive to the roughened upper surface;

securing a cushioning layer to the adhesive on the roughened upper surface; and securing a cover layer on top of the cushioning layer.

The cover layer may be secured to the cushioning layer either before or after securing the cushioning layer to the roughened upper surface of the plastic lower layer. The upper surface of the plastic layer may be roughened by any suitable technique, such as sand blasting.

The arch support device of this invention will provide a good support for the arch of the wearer's foot while still providing cushioning and comfort in regions of maximum pressure. The device is relatively inexpensive to manufacture and can be made in all appropriate arch support sizes.

BRIEF DESCRIPTION OF THE DRAWINGS

The present invention will be better understood from the following detailed description of an exemplary embodiment of the invention, taken in conjunction with the accompanying drawings in which like reference numerals refer to like parts and in which.

DETAILED DESCRIPTION OF THE DRAWINGS

Figure 1:
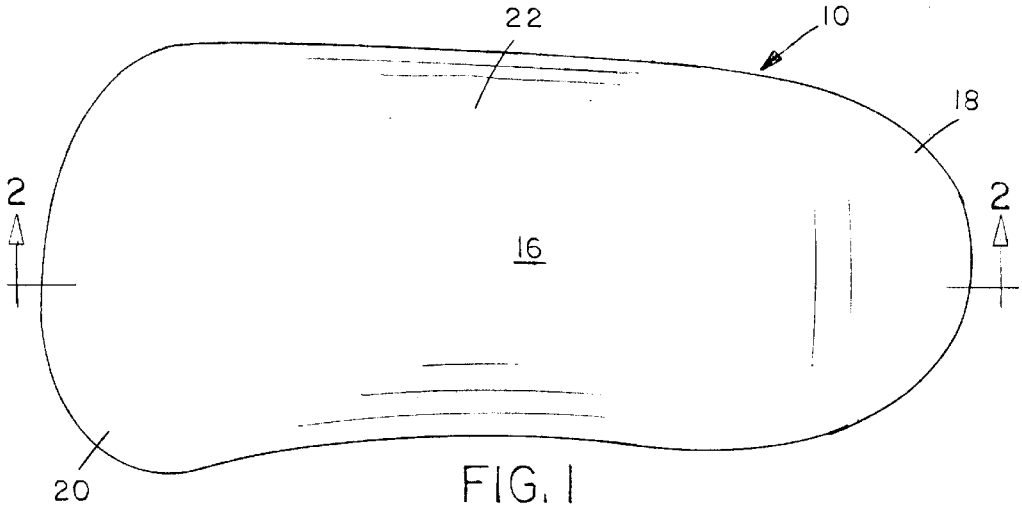
FIG. 1 is a top plan view of an arch support device according to an exemplary embodiment of the invention.

FIGS 1 to 4 of the drawings illustrate an arch support device 10 according to an exemplary embodiment of the invention. The device 10 basically comprises a lower layer 12 of rigid or semi-rigid material, a core or inner layer 14 of cushioning material such as foam, and an upper, cover layer 16. The lower layer 12 has a predetermined contour shaped to conform to the contour of at least part of the sole of a foot, extending at least from a heel region 18 up to a metatarsal rise region 20 and including the arch region 22. The arch support device may be made in a ¾ foot length or full foot length, as is known in the field for conventional one layer arch supports.

In one specific example of the arch support device of FIGS. 1 to 4, the lower layer 12 was of EVA plastic or other relatively hard or rigid plastic material, the core or middle layer 14 was of foam material, and the cover layer 16 was of leather. The three layers were adhered together by a suitable adhesive.

Figure 2:
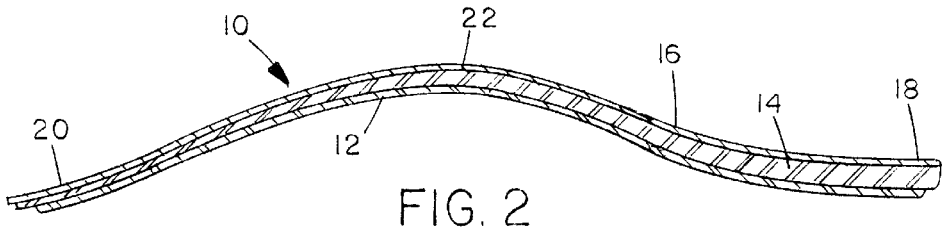
FIG. 2 is a cross-sectional view of the arch support device on the lines 2—2 of FIG. 1.
Figure 4:
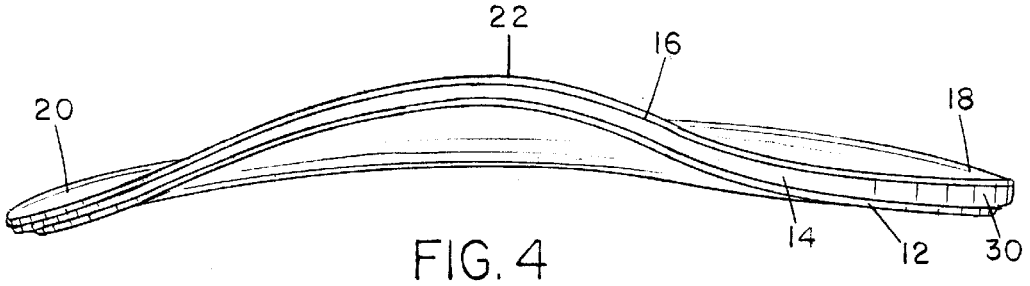
FIG. 4 is a side elevation view of the arch support device.

As indicated in FIGS. 2 and 4, the core layer 14 of foam material is of tapering thickness along the length of device 14, with the thickest region 30 corresponding to the heel region 18. The region 30 is thicker than the other two layers, to provide sufficient cushioning for the wearer's foot from the relatively hard surface of the lower, arch supporting layer 12.

Figure 3:
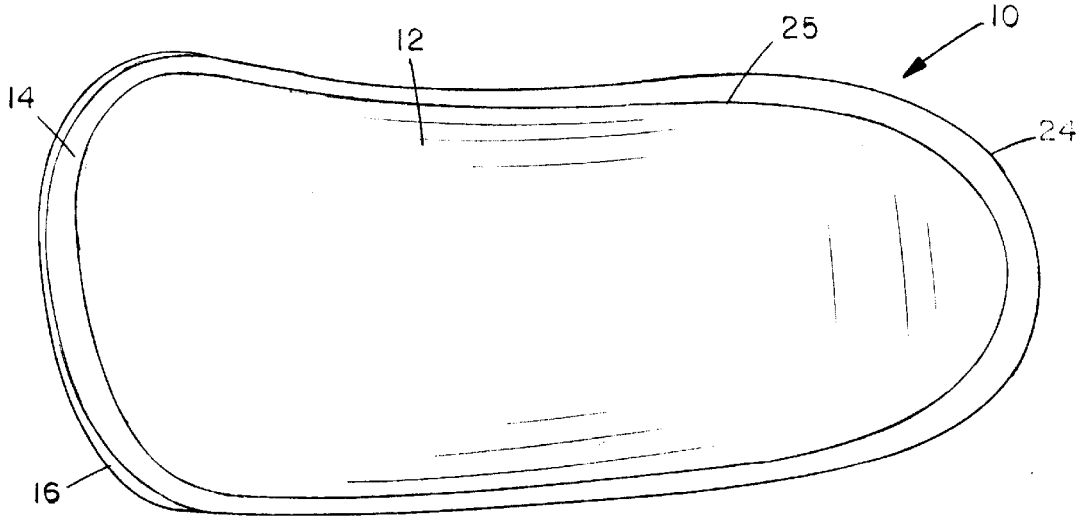
FIG. 3 is a bottom plan view of the arch support device.

The foam layer then tapers down to minimum thickness at the toe region or metatarsal rise. The reduction in thickness from the heel region to the toe region may be of the order of 25% to 75%. The thickness of the foam layer 14 in the heel region may be of the order of 5 to 10 mm., while the thickness in the toe region may be 0.5 to 2 mm. As indicated in FIGS. 2 and 3, the foam and cover layers have an outer peripheral edge 24 which projects outwardly beyond the periphery 25 of the lower, rigid or semirigid layer 12, forming a projecting rim of cushioning material around the entire periphery of the device. This provides for added comfort of the wearer, since the edge of their foot will not contact the relatively hard rim or periphery of the lower layer even when the cushion and cover layers are pressed down during wear.

The three layer construction with a central core layer of foam material provides for adequate arch support with increased comfort. The user's foot will be supported properly in the arch region, but the foam cushioning layer will avoid pressing of the sole of the foot directly against the relatively rigid lower layer which is contoured for the desired supporting function. The maximum thickness of foam in the heel region gives more cushioning in the area where maximum pressure is normally applied, while the reduced thickness foam layer in the toe region gives more support and allows easier insertion of the foot into the shoe.

The thickness of foam layer 14 may be uniform from the heel region up to the arch region, and then taper gradually from the arch to the toe, where less cushioning is necessary or may taper uniformly from the heel to the toe. The thinner foam portion in the toe region assists in support in this area, while also allowing the foot to enter the shoe more readily when the device is in place.

Figure 5:
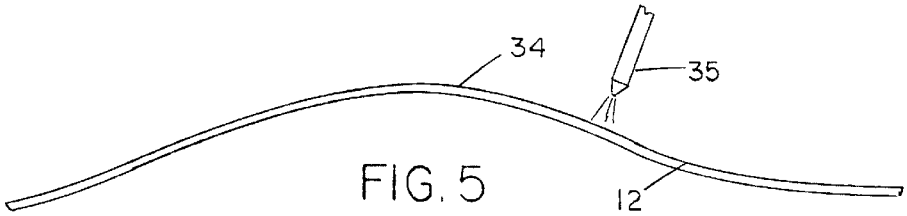
FIG. 5 is a side view of the lower layer of the arch support device showing roughening of the upper surface during manufacture.
Figure 6:
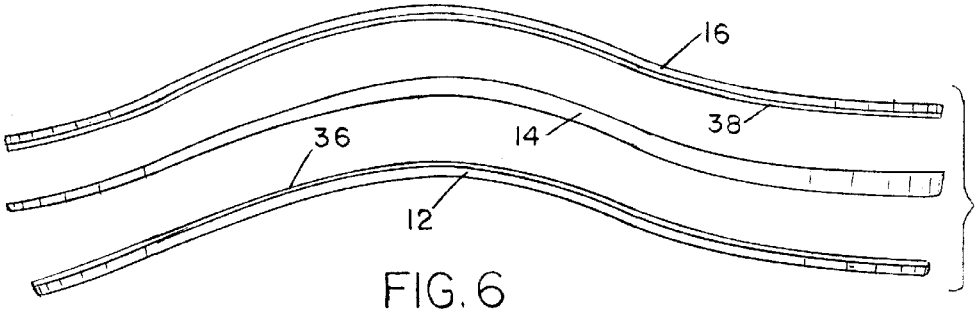
FIG. 6 is a side view of the separated layers showing application of adhesive prior to adhering the layers together.

FIGS. 5 and 6 illustrate steps in a method of manufacturing the arch support device of FIGS. 1 to 4. In this method, the arch support or lower layer 12 of rigid or semi-rigid plastic material is first molded into the appropriate shape and contour. The upper surface 34 of this layer is then roughened, for example by sand blasting using a sand blasting tool 35, as indicated in FIG. 5. Once the entire upper surface has been roughened, a layer 36 of a suitable adhesive is applied to the upper surface, as illustrated in FIG. 6. A layer 38 of adhesive is also applied to the lower surface of the cover layer 16, and the three layers are subsequently adhered together.

The arch support device of this invention has advantages over known rigid or semi-rigid arch support devices, as well as known cushioning insoles. It will be more comfortable to wear than a conventional arch support device which is substantially rigid and may cause discomfort to the sole of a wearer's foot, while providing better support to a wearer's foot than footwear containing a fully compressible insole. The tapered foam layer provides more cushioning in the heel region, where maximum pressure is normally applied, with gradual reduction in foam thickness to the toe, for better support. This also makes the device thinner at the toe, so that the foot can enter the shoe more easily.

Although an exemplary embodiment of the invention have been described above by way of example only, it will be understood by those skilled in the field that modifications may be made to the disclosed embodiments without departing from the scope of the invention, which is defined by the appended claims.

I claim:

1. An arch support device for removable insertion into a shoe, comprising:

a first, lower layer of a rigid material shaped to conform to the arch of a wearer's foot and to provide an arch supporting function when removably inserted in a shoe, the lower layer having a lower face for facing a sole of an item of footwear, an upper face, a heel region at one end, an arch region, and a toe region;

a second layer of cushioning material secured to the upper face of the lower layer; and a third, cover layer of pliable material secured over the second layer;

the second layer being of variable thickness and having a maximum thickness region overlying the heel region of the lower layer and a minimum thickness region overlying the toe region; and the second layer extending continuously and without interruption between the heel region and toe region of the underlying first layer and separating the first and third layers along the entire length of the device.

2. The device as claimed in claim 1, wherein the second layer is of foam material.

3. The device as claimed in claim 1, including a first adhesive layer securing the lower layer to the second layer and a second adhesive layer securing the second layer to the cover layer.

4. The device as claimed in claim 1, wherein the lower layer is of hard plastic material.

5. The device as claimed in claim 1, wherein the maximum thickness region of the second layer is thicker than the lower and cover layers.

6. The device as claimed in claim 1, wherein the minimum thickness is in the range from 25% to 75% of the maximum thickness.

7. An arch support device for removable insertion into a shoe, comprising:

a first, lower layer of a rigid or semirigid material shaped to conform to the arch of a wearer's foot and to provide an arch supporting function when removably inserted in a shoe, the lower layer having a lower face for facing a sole of an item of footwear, an upper face, a heel region at one end, an arch region, and a toe region;

a second layer of cushioning material secured to the upper face of the lower a third, cover layer of pliable material secured over the second layer;

the second layer being of variable thickness and having a maximum thickness region overlying the heel region of the lower layer and a minimum thickness region overlying the toe region; and the second layer extending continuously and without interruption between the heel region and toe region of the underlying first layer and separating the first and third layers along the entire length of the device.

8. An arch support device, comprising:

a first, lower layer of a rigid or semirigid material shaped to conform to the arch of a wearer's foot and to provide an arch supporting function when inserted in a shoe, the lower layer having a lower face for facing a sole of an item of footwear, an upper face, a heel region at one end, an arch region, and a toe region;

a second layer of cushioning material secured to the upper face of the lower layer; and a third, cover layer of pliable material secured over the second layer;

the second layer being of variable thickness and having a maximum thickness region overlying the heel region of the lower layer and a minimum thickness region overlying the toe region; and the thickness of the second layer gradually and continuously from the heel region to the toe region.

9. An arch support device, comprising:

a first, lower layer of a rigid or semirigid material shaped to conform to the arch of a wearer's foot and to provide an arch supporting function when inserted in a shoe, the lower layer having a lower face for facing a sole of an item of footwear, an upper face, a heel region at one end, an arch region, and a toe region;

a second layer of cushioning material secured to the upper face of the lower layer; and a third, cover layer of pliable material secured over the second layer;

the second layer being of variable thickness and having a maximum thickness region overlying the heel region of the lower layer and a minimum thickness region overlying the toe region; and the lower layer having an outer rim and the second and cover layers each having a peripheral rim extending outwardly beyond the outer rim of the lower layer to form a projecting portion of substantially uniform width extending around the entire periphery of the outer rim of the lower layer.

10. The device as claimed in claim 9, wherein the peripheral rim of the second layer is tapered outwardly from the lower layer to the cover layer.

* * * * *